US010046906B2

(12) United States Patent
Luo et al.

(10) Patent No.: US 10,046,906 B2
(45) Date of Patent: Aug. 14, 2018

(54) TANK TYPE CONTAINER

(71) Applicants: Nantong CIMC Tank Equipment Co., Ltd., Jiangsu (CN); China International Marine Containers (Group) Ltd., Shenzhen, Guangdong (CN); CIMC Enric Investment Holdings (ShenZhen) Co., Ltd., Shenzhen, Guangdong (CN)

(72) Inventors: Yongxin Luo, Jiangsu (CN); Chunrong Yao, Jiangsu (CN); Huanghe Quan, Jiangsu (CN); Xiuli Li, Jiangsu (CN); Xiaoxiang Zhou, Jiangsu (CN); Ronald Eppers, Jiangsu (CN)

(73) Assignees: Nantong CIMC Tank Equipment Co., Ltd., Jiangsu (CN); China International Marine Containers (Group) Ltd., Guangdong (CN); CIMC Enric Investment Holdings (Shenzhen) Co., Ltd., Guangdong (CN)

( * ) Notice: Subject to any disclaimer, the term of this patent is extended or adjusted under 35 U.S.C. 154(b) by 0 days.

(21) Appl. No.: 15/304,647

(22) PCT Filed: Jan. 8, 2015

(86) PCT No.: PCT/CN2015/070375
§ 371 (c)(1),
(2) Date: Oct. 17, 2016

(87) PCT Pub. No.: WO2015/158164
PCT Pub. Date: Oct. 22, 2015

(65) Prior Publication Data

US 2017/0043945 A1 Feb. 16, 2017

(30) Foreign Application Priority Data

Apr. 18, 2014 (CN) ..... 2014 1 0158908
Apr. 18, 2014 (CN) ..... 2014 2 0193062 U

(51) Int. Cl.
*B65D 88/12* (2006.01)
*B65D 90/20* (2006.01)
*B65D 90/12* (2006.01)

(52) U.S. Cl.
CPC ..... *B65D 88/128* (2013.01); *B65D 90/12* (2013.01); *B65D 90/20* (2013.01)

(58) Field of Classification Search
CPC .. B65D 88/128; B65D 88/129; B65D 88/121; B65D 88/12; B65D 90/20; B65D 90/12;
(Continued)

(56) References Cited

U.S. PATENT DOCUMENTS

2014/0109992 A1* 4/2014 Ness ..... B65D 19/385 137/376

FOREIGN PATENT DOCUMENTS

CN 201161785 Y 12/2008
CN 101519155 A 9/2009
(Continued)

*Primary Examiner* — Robert J Hicks
(74) *Attorney, Agent, or Firm* — McDonnell Boehnen Hulbert & Berghoff LLP

(57) ABSTRACT

A tank type container, comprising a tank (1), two end frames (2) respectively fixed at two ends of the tank (1), and at least one saddle (3) located at the bottom of the outer wall of the tank (2); an upward concave gooseneck hole (27) is formed in the bottom of the saddle (3) for insertion of the gooseneck of a semitrailer front end; and at least one saddle (3) is adjacent to one of the end frames (2), and forms a gap with the end frame (2). The saddle (3) and the end frame (2) are spaced a certain distance, thus greatly shortening the length of the saddle (3), reducing the manufacturing cost of the saddle (3) as the gooseneck hole, reducing the dead weight of the entire vehicle, and improving the competitiveness of the product.

20 Claims, 17 Drawing Sheets

(58) Field of Classification Search
CPC ..... B65D 25/22; B65D 25/24; B60P 3/2205; B60P 3/2225; B60P 3/2215; B60P 3/221; B60P 3/22; F17C 13/083; F17C 13/08
USPC ..... 220/636, 628, 1.5; 206/0.6; 248/311.2; 280/833, 837, 838; 105/213, 211, 419, 105/414, 413
See application file for complete search history.

(56) References Cited

FOREIGN PATENT DOCUMENTS

| | | | |
|---|---|---|---|
| CN | 102020073 | A | 4/2011 |
| CN | 102745433 | A | 10/2012 |
| CN | 102837909 | A | 12/2012 |
| CN | 2033195056 | | 12/2013 |
| CN | 203486402 | | 3/2014 |
| CN | 20385507 | | 10/2014 |
| DE | 20010144 | | 6/2000 |
| EP | 0 413 195 | A1 | 2/1991 |

* cited by examiner

TANK TYPE CONTAINER

CROSS REFERENCE

The present application is a continuing application of International Application No. PCT/CN2015/070375, filed on Jan. 8, 2015, which is based upon and claims priority to Chinese Patent Application No. 201410158908.5, filed on Apr. 18, 2014, and Chinese Patent Application No. 201420193062.4, filed on Apr. 18, 2014, and the entire contents thereof are incorporated herein by reference.

TECHNICAL FIELD

The disclosure relates to storage and transportation equipment, and more specifically, a tank type container.

BACKGROUND

In semitrailers for road transportation, there are different structures. Typically, a North American semitrailer has a gooseneck and it is more than 3 meters long. In order to match with the North American semitrailer, at a front end of an existing dry container, the bottom is depressed inward at a position, and a gooseneck groove structure is provided at the depressed position. Such a gooseneck groove is typically made of a whole plate which is bent and folded, and has a cross section roughly in a shape of Ω, moreover, a length of the gooseneck groove is substantively as same as the length of the gooseneck on the semitrailer.

With development of the transposition, the tank type containers are used more and more widely. Especially in road transportation, the tank type containers play a vital role. Typically, a tank type container comprises a tank, end frames disposed on both sides of the tank, and a supporting structure disposed in a bottom of the tank. The supporting structure is used for transferring load, or improving an overall rigidity and strength of the container. However, typically, the supporting structure in the bottom of the front end of the tank type container would interfere with the gooseneck of the semitrailer, causing the supporting structure failed to match and mount the gooseneck. For the problems, the existing tank type container, similar to the dry container, also has a gooseneck groove made of a bent and folded whole plate disposed in the bottom of the tank, and the gooseneck groove continuously extends backward from positions of the end frames of the tank type container, moreover, the gooseneck groove has a length substantively as same as the length of the gooseneck of the semitrailer. When the tank type container is matched with the semitrailer, the gooseneck groove would covert the whole section of the gooseneck of the semitrailer. However, for the tank type containers, such a structure of the gooseneck groove suffers from a complex manufacturing process, and a relative high manufacturing cost.

SUMMARY

In order to overcome the shortcomings of the existing technology, the disclosure provides a tank type container, which may optimize the groove structure in the bottom of the tank type container, simplify the manufacturing process of the tank type container, and reduce the manufacturing cost of the gooseneck groove.

In order to overcome the above-mentioned technical problems, the disclosure provides a tank type container comprising: a tank, two end frames respectively fixed to both ends of the tank, and at least one saddle located at a bottom of an outer wall of the tank, a gooseneck groove concave upwards is formed in the bottom of the saddle for allowing insertion of a gooseneck at a front end of a semitrailer, and the at least one saddle is close to one of the end frames and has a gap formed between itself and the end frame.

Preferably, a gap between a front end face of the saddle and a rear end face of the end frame is 420 mm-1820 mm.

Preferably, the saddle has a length of 25 mm-600 mm.

Preferably, the saddle comprises two tank supporters oppositely disposed in the lateral direction, and the gooseneck groove is formed between the two tank supporters.

Preferably, the two tank supporters of the same saddle are separated from each other.

Preferably, the two tank supporters of the same saddle are connected into an integrated entity.

Preferably, the tank supporters have a hollow structure formed by assembling a plurality of plates or integrally-formed.

Preferably, the tank supporters comprises an inner support plate and an outer support plate, the outer support plate is disposed an outer side of the tank, the inner support plate is disposed on an inner side of the outer support plate, moreover, the inner support plate, the outer support plate, and the outer wall of the tank form a hollow cavity.

Preferably, the inner support plates of the two tank supporters of the same saddle are separated from each other, a bottom end of the inner support plate and a bottom end of the outer support plate of the same tank supporter are connected to each other, a top end of the inner support plate and a top end of the outer support plate of the same tank supporter are separated from each other, moreover, top ends of the inner support plate and the outer support plates are all connected onto the outer wall of the tank, and each of the supporters and the outer wall of the tank form a hollow cavity with both front and rear ends opened.

Preferably, the inner support plate from bottom to top comprises: a bottom subsection, a side subsection, a shoulder subsection, and a neck subsection, the bottom subsection is parallel to a horizontal plane, the side subsection is formed by initially extending inclined upward from an inner end of the bottom subsection and then vertically extends upward, the shoulder subsection is formed by horizontally extending inward from an upper end of the side subsection, the neck subsection is formed by vertically extending upward from an inner end of the shoulder subsection, and a top end of the neck subsection and the outer wall of the tank are connected to each other; the shoulder subsections of the two tank supporters of the same saddle are flush with each other, and a bottom surface of the shoulder subsection forms a load transfer surface.

Preferably, the bottom subsections of the two tank supporters of the same saddle are flush with each other, and a bottom surface of the bottom subsection forms another load transfer surface.

Preferably, each of the tank supporters is provided with two end covers, the two end covers are oppositely disposed at both ends of the tank supporters, the end covers are respectively connected to the inner support plate, the outer support plate, and the outer wall of the tank, so as to close the opened front and rear ends of the hollow cavity.

Preferably, the inner support plates of the two tank supporters of the same saddle are connected into an integrated entity, the two tank supporters and the outer wall of the tank form a hollow cavity with both front and rear ends opened.

Preferably, the inner support plate comprises a bottom subsection, a side subsection, a shoulder subsection, the bottom subsection is parallel to a horizontal plane, the side subsection is formed by initially extending inclined upward from the bottom subsection and then vertically extending upward, the shoulder subsection is formed by horizontally extending inward from a top end of the side subsection, the shoulder subsections of the two tank supporters are flush with each other and connected into an integrated entity.

Preferably, there is a gap between the outer wall of the tank and the shoulder subsection of the inner support plate, and a reinforcing plate is connected between the outer wall of the tank and the shoulder subsection of the inner support plate.

Preferably, the reinforcing plate is distributed in the longitudinal direction, and located right above the side subsection.

Preferably, each saddle is provided with two end covers, the two end covers are oppositely disposed at both ends of the saddle, the end covers are respectively connected to the outer support plate, the inner support plate, and the outer wall of the tank, so as to close the opened front and rear ends of the hollow cavity.

Preferably, the outer support plate is perpendicular to a horizontal plane.

Preferably, the outer support plate comprises an inclined section inclining gradually from bottom to top outward and a vertical section vertically extending upward from a top end of the inclined section.

Preferably, a bottom end of the outer support plate and a bottom end of the inner support plate are connected to each other, a top end of the outer support plate is connected onto the outer wall of the tank.

Preferably, the outer wall of the tank has an arc stiffener circumferential disposed thereon, a bottom end of the outer support plate and a bottom end of the inner support plate are connected to each other, a top end of the outer support plate is fixed onto the stiffener.

Preferably, a wrapping angle of the saddle for the tank is 90°-150°.

Preferably, a number of the saddles is two, one of the saddles is close to one end of the tank, and another one of the saddles is close to another end of the tank.

Preferably, the end frame comprises: two corner pillars, an end upper beam and an end lower beam, the two corner pillars are parallel to each other, the end upper beam is connected between top ends of the two corner pillars, the end lower beam is connected between bottom ends of the two corner pillars, top corner fittings are disposed at top ends of the corner pillars, and bottom corner fittings are disposed at bottom ends of the corner pillars, a bottom surface of the end lower beam is provided with two oppositely disposed end frame supporters, and a gooseneck groove is formed between the two end frame supporters.

Preferably, the end frame supporter is made from one bent plate.

Preferably, the end frame supporter comprises an outer plate, a bottom plate, and an inner plate. The bottom plate is parallel to a horizontal plane, a bottom end of the outer plate is connected to an outer end of the bottom plate, a top end of the outer plate is connected to a bottom surface of the end lower beam, a bottom end of the inner plate is connected to an inner end of the bottom plate, and a top end of the inner plate is connected to a bottom surface of the end lower beam. The outer plate, the bottom plate, the inner plate, and the bottom surface of the end lower beam form a through hole opened at both ends.

Preferably, the inner plate comprises a vertical subsection and an inclined subsection, the vertical subsection is perpendicular to a horizontal plane, the inclined subsection is formed by bending outward from the vertical subsection.

Preferably, at least one closure sheet may be disposed on the end frame supporter, and the closure sheet may be connected to the inner plate, the bottom plate, the outer plate, and a bottom surface of the end lower beam for closing the opened ends of the through hole.

Preferably, a gap is formed between the end frame supporter and an adjacent corner fitting, and the end frame supporter, the end lower beam, and the adjacent corner fitting form an avoidance groove.

Preferably, the two tank supporters are symmetric about a longitudinal central plane of the tank; the two end frame supporters are also symmetric about a longitudinal central plane of the tank, and a distance between the two tank supporters is equal to a distance between the two end frame supporters.

Preferably, a bottom surface of the end frame supporter is higher than a bottom surface of the bottom corner fitting.

Preferably, a distance from the bottom surface of the end frame supporter to the bottom surface of the bottom corner fitting is about 11 mm-17.5 mm.

Preferably, an inclined strut is connected between each saddle and an adjacent end frame.

Preferably, two inclined struts are connected between each saddle and the adjacent end frame; the two inclined struts form a splayed shape; each of the inclined struts has one end connected onto the tank supporters, and has the other end s connected to a bottom of the end frame at a position close to outside.

Preferably, a corner supporter is connected between the inclined strut and the end frame supporter.

It is clear from the above-mentioned solutions, the disclosure has the following advantages and advantageous effects:

I. The saddle according to the disclosure may provide support for the tank, and provide a gooseneck groove structure for matching the gooseneck of the semitrailer as well, such that the tank type container with the saddle may simultaneously match a semitrailer having no gooseneck structure, and match a semitrailer having a gooseneck structure;

II. Since the saddle and the end frame are separated by a distance, the length of the saddle itself is shortened greatly, thus reducing the manufacturing cost of the saddle as the gooseneck groove;

III, The saddle is formed by two tank supporters which are separated from each other, such that a height of the gooseneck groove formed between the two tank supporters may be reduced as much as possible, thus barycenter of the tank is lowered, and safety of the tank during transportation is improved;

IV. The saddle according to the disclosure has a hollow box like structure which is easier to be processed compared with the gooseneck groove according to the related art, and the production efficiency is improved accordingly. In addition, maintenance of the saddle with such hollow box like structure may be easily performed, no replacement of the entire part is necessary, so maintenance cost is reduced;

V. The end frame supporter according to the disclosure is formed by a piece of a plate via a process of bending and folding, since the end frame supporter has a small size, it is easy to be formed by bending and folding, thus the production efficiency may be improved;

VI. The saddle and the end frame are connected to each other through the inclined strut, such that a strength of the saddle is greatly improved, and service life is achieved.

Figure 1:
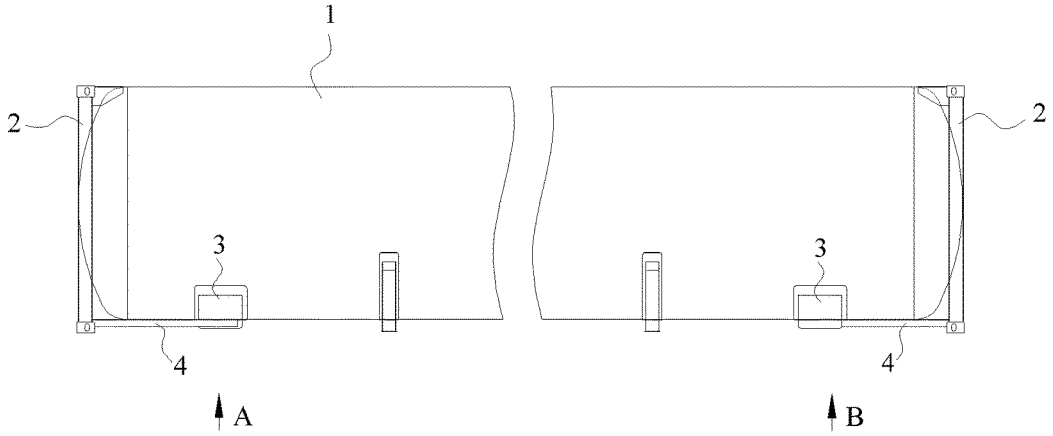
FIG. 1 is a side structural representation of a tank type container of the disclosure.

Reference numerals in the drawings will be listed as follows: "1" is used to indicate a tank; "11" is used to indicate a stiffener; "2" is used to indicate an end frame; "21" is used to indicate a corner pillar; "22" is used to indicate an end upper beam; "23" is used to indicate an end lower beam; "24" is used to indicate a bottom corner fitting; "25" is used to indicate a top corner fitting; "26" is used to indicate an end frame supporter; "261" is used to indicate a closure sheet; 262 is used to indicate an inner plate; "2621" is used to indicate a vertical subsection; "2622" is used to indicate an inclined subsection; "263" is used to indicate a bottom plate; "264" is used to indicate a an outer plate; "27" is used to indicate a gooseneck groove; "28" is used to indicate an avoidance groove; "3" is used to indicate a saddle; "31" is used to indicate a tank supporter; "311" is used to indicate an inner support plate; "3111" is used to indicate a bottom subsection; "3112" is used to indicate a side subsection; "3113" is used to indicate a shoulder subsection; "3114" is used to indicate a neck subsection; "312" is used to indicate an outer support plate; "3121" is used to indicate an inclined section; "3122" is used to indicate a vertical section; "313" is used to indicate an end cover; "314" is used to indicate a reinforcing plate; "32" is used to indicate a gooseneck groove; "4" is used to indicate a an inclined strut; "5" is used to indicate a corner supporter; "9" is used to indicate a semitrailer; and "91" is used to indicate a gooseneck structure.

DETAILED DESCRIPTION

Some typical embodiments which may present features and advantages of the disclosure will be discussed in detail herein below. It would be appreciated that the disclosure may be carried out variously without departing from the range of the disclosure. Moreover, the embodiments described and shown here are merely as illustrative examples, rather than limits to the disclosure.

In order to indicate positions and directions clearly, throughout the disclosure, the direction parallel to the length of the tank are referred to as the longitudinal direction and the direction parallel to the width of the tank are referred to as lateral direction.

Please refer to FIG. 1, a tank type container of the disclosure comprises a tank 1, two end frames 2 respectively fixed to both ends of the tank 1, and two saddles 3 located at a bottom of an outer wall of the tank 1.

The tank 1 has a structure which is as same as that in the relate art, and redundant descriptions are ruled out.

Each of the end frames 2 and the saddles 3 has a bottom with a gooseneck groove concave upwards formed therein for allowing insertion of a gooseneck at a front end of a semitrailer.

Figure 12:
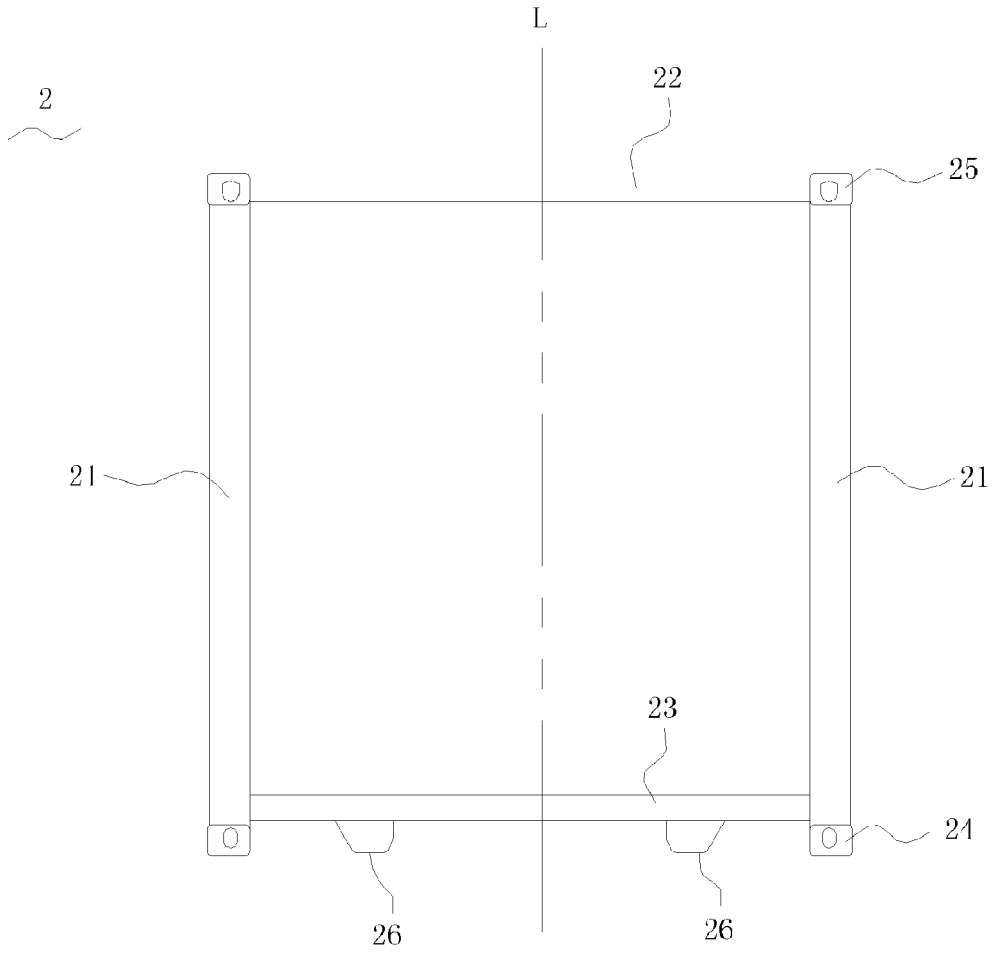
FIG. 12 shows a structural representation of an end frame.
Figure 13:
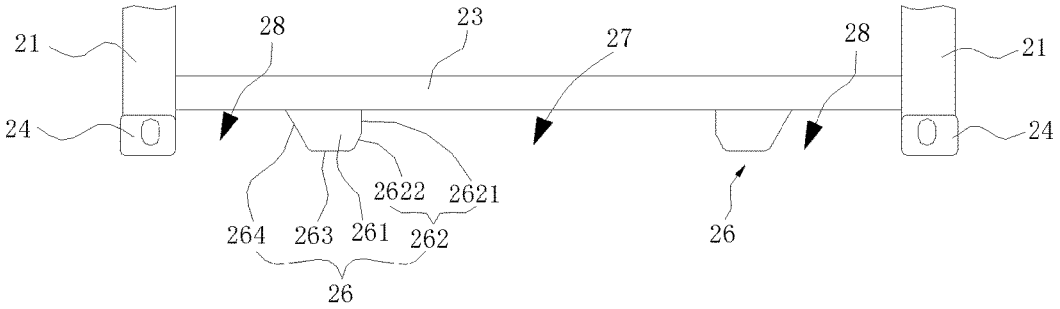
FIG. 13 shows a structural representation of a part of a lower end of an end frame.

Please refer to FIGS. 12 and 13, each of the end frames 2 comprises: two corner pillars 21, an end upper beam 22 and an end lower beam 23. The two corner pillars 21 are parallel to each other, and the end upper beam 22 is connected between top ends of the two corner pillars 21. The end lower beam 23 is connected between bottom ends of the two corner pillars 21. A top end of each of the corner pillars 21 is provided with a top corner fitting 25, and a bottom end of each of the corner pillars 21 is provided with a bottom corner fitting 24.

A bottom surface of the end lower beam 23 is provided with two oppositely disposed end frame supporters 26. The two end frame supporters 26 are symmetrically distributed about a longitudinal central plane L of the tank. The respective end frame supporters 26 are disposed protruding from the bottom surface of the end lower beam 23, and a gooseneck groove 27 is formed between the two end frame supporters 26, for matching the gooseneck of the semitrailer. According to an embodiment, a width of the end frame supporter 26 is equal to a width of the end lower beam 23.

Figure 14:
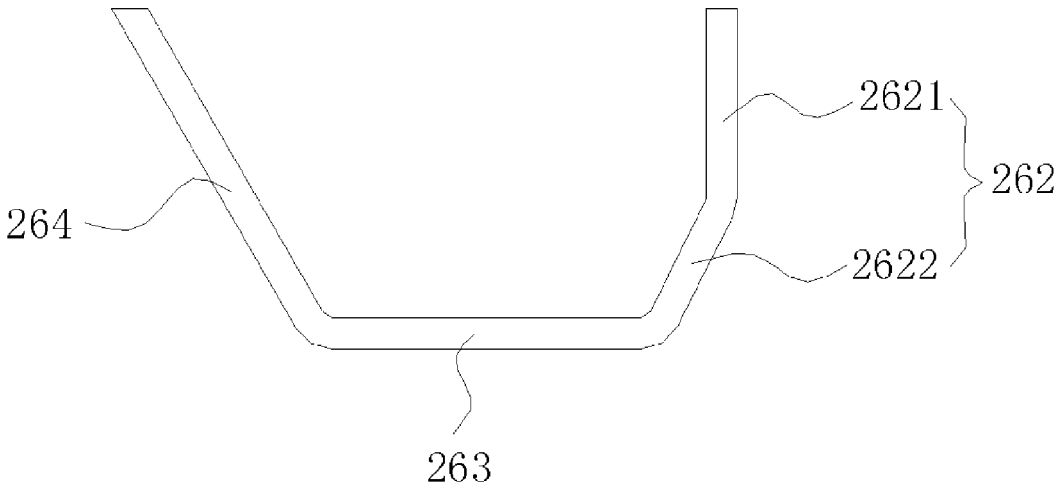
FIG. 14 shows a structural representation of an end frame supporter.

Please refer to FIGS. 13 and 14, the end frame supporter 26 may be made from one bent plate, and comprises: an inner plate 262, a bottom plate 263, and an outer plate 264. The bottom plate 263 is parallel to a horizontal plane. A bottom end of the outer plate 264 is connected to an outer end of the bottom plate 263. A top end of the outer plate 264 is connected to a bottom surface of the end lower beam 23. A bottom end of the inner plate 262 is connected to an inner end of the bottom plate 263. A top end of the inner plate 262 is connected to the bottom surface of the end lower beam 23. The outer plate 264, the bottom plate 263, the inner plate 262, and the bottom surface of the end lower beam 23 form a through hole with both ends opened in the longitudinal direction. Further, at least one closure sheet 261 may be disposed on the end frame supporter 26, and the closure sheet 261 may be connected to the inner plate 262, the bottom plate 263, the outer plate 264 and the end lower beam 23 for closing the opened ends of the through hole for preventing rain from entering to the end frame supporter 26 and causing erosion. Meanwhile, the closure sheet 261 is also helpful for improving the strength of the end frame supporter 26, so as to prevent the inner plate 262 and the outer plate 264 from being deformed due to an excessive force in the lateral direction.

In a preferred embodiment, the inner plate 262 has a bent structure, and comprises a vertical subsection 2621 and an inclined subsection 2622. The vertical subsection 2621 is perpendicular to a horizontal plane; the inclined subsection 2622 is formed by bending the vertical subsection 2621 outwardly. A horn like gooseneck groove 27 with a bottom expanding gradually is formed between the inner plates 262 of the two end frame supporters 26. When the tank type container is mounted on a gooseneck type semitrailer, the horn like gooseneck groove 27 may provide a connecting guidance for the gooseneck of the semitrailer, so that even the gooseneck groove 27 is not completely centered to the gooseneck of the semitrailer, the gooseneck may easily slide in between the two vertical subsections 2621 of the inner plate 262 via the inclined subsection 2622 of the inner plate 262.

Moreover, during hoisting and aligning of two tank type containers, in order to prevent the end frame supporter 26 at the bottom of the end frame 2 of the upper tank type container from hitting the top corner fittings 25 of the lower tank type container, an avoidance groove 28 may be disposed at a position on the end lower beam 23 close to the bottom corner fittings 24. More specifically, the two end frame supporters 26 may be respectively separated from the adjacent corner fittings 24, and the avoidance groove 28 may be formed by surrounding the end frame supporters 26, the end lower beam 23 and the adjacent corner fittings 24.

The end frame 2 discussed above can be applied to various semitrailers comprising semitrailers with or without a gooseneck device. For matching a semitrailer with a gooseneck device, the inner plates 262 of the two end frame supporters 26 and the bottom surface of the end lower beam 23 between the two end frame supporters 26 cooperate with the gooseneck device of the semitrailer, so that a bottom surface of the end lower beam 23 between the two end frame supporters 26 may function as a load transfer area, to transfer load from the end frame 2 onto the semitrailer. When the end frame 2 is matched with a normal semitrailer without a gooseneck device, the bottom surfaces of the two end frame supporters 26 may function as a load transfer area to directly contact the bearing surface of the semitrailer, and transfer load onto the semitrailer. Therefore, a plurality of load transfer areas are formed by the end frame 2, such that the structure of the end frame 2 is capable of matching any semitrailer, no matter the semitrailer has or has not a gooseneck device.

Figure 15:
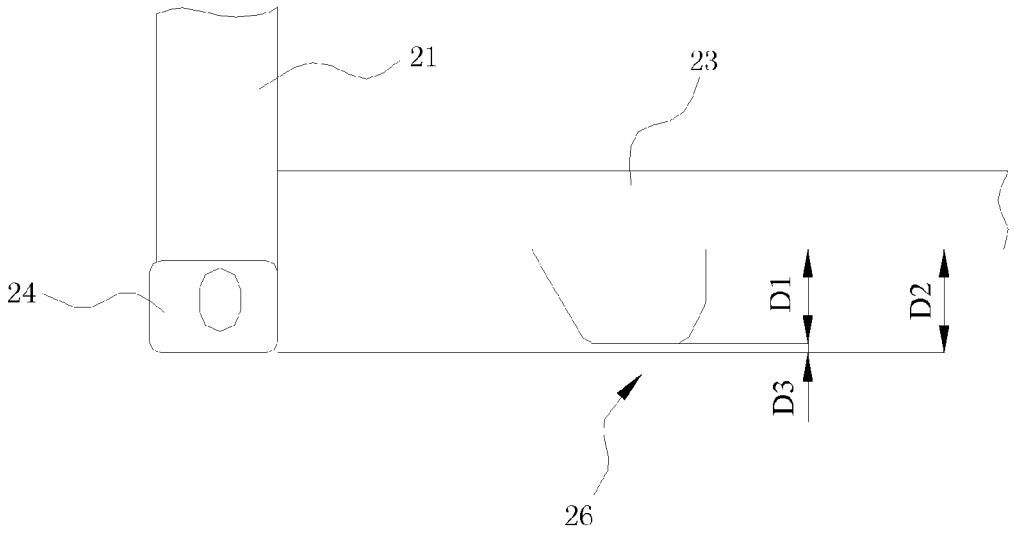
FIG. 15 shows a structural representation of a left part of a lower end of an end frame.

Please refer to FIG. 15, when the end frame 2 is matched with the semitrailer having no gooseneck device, in order to prevent the end frame supporter 26 from deforming due to compression, the bottom surface of the end frame supporter 26 may be higher than the bottom surface of the bottom corner fitting 24 at a certain distance. The end frame supporter 26 has a height D1, from the bottom surface of the end lower beam 23 to the bottom surface of the bottom corner fitting 24 there is a distance D2, and from the bottom surface of the end frame supporter 26 to the bottom surface of the bottom corner fitting 24 there is a distance D3. D2 is greater than D1, and D3=D2−D1, in addition, D3 may be about 11 mm-17.5 mm. For different kinds of semitrailers, the height D1 of the end frame supporter 26 may be set to different values, for example, about 120 mm or 79 mm. On the one hand, the distance D3 from the bottom surface of the end frame supporter 26 to the bottom surface of the bottom corner fitting 24 may provide a downward space for the end lower beam 23 to carry out load, so as to prevent the end lower beam 23 from excessively protruding downward and causing the end frame supporter 26 deformed due to compression. On the other hand, the distance D3 from the bottom surface of the end frame supporter 26 to the bottom surface of the bottom corner fitting 24 should be set in a certain range, when the tank 1 of tank type container is fully loaded, load is transfer to the end lower beam 23 via the end frame 2, and the end lower beam 23 protrudes downward a little. Here, the distance D3 from the bottom surface of the end frame supporter 26 to the bottom surface of the bottom corner fitting 24 would decrease gradually to 0, so that the end frame supporter 26 may also function to transfer load, and share load carried by the end lower beam 23, so as to prevent the end lower beam 23 from deforming due to excessive load, and prevent the end lower beam 23 from fatigue damage.

Figure 2:
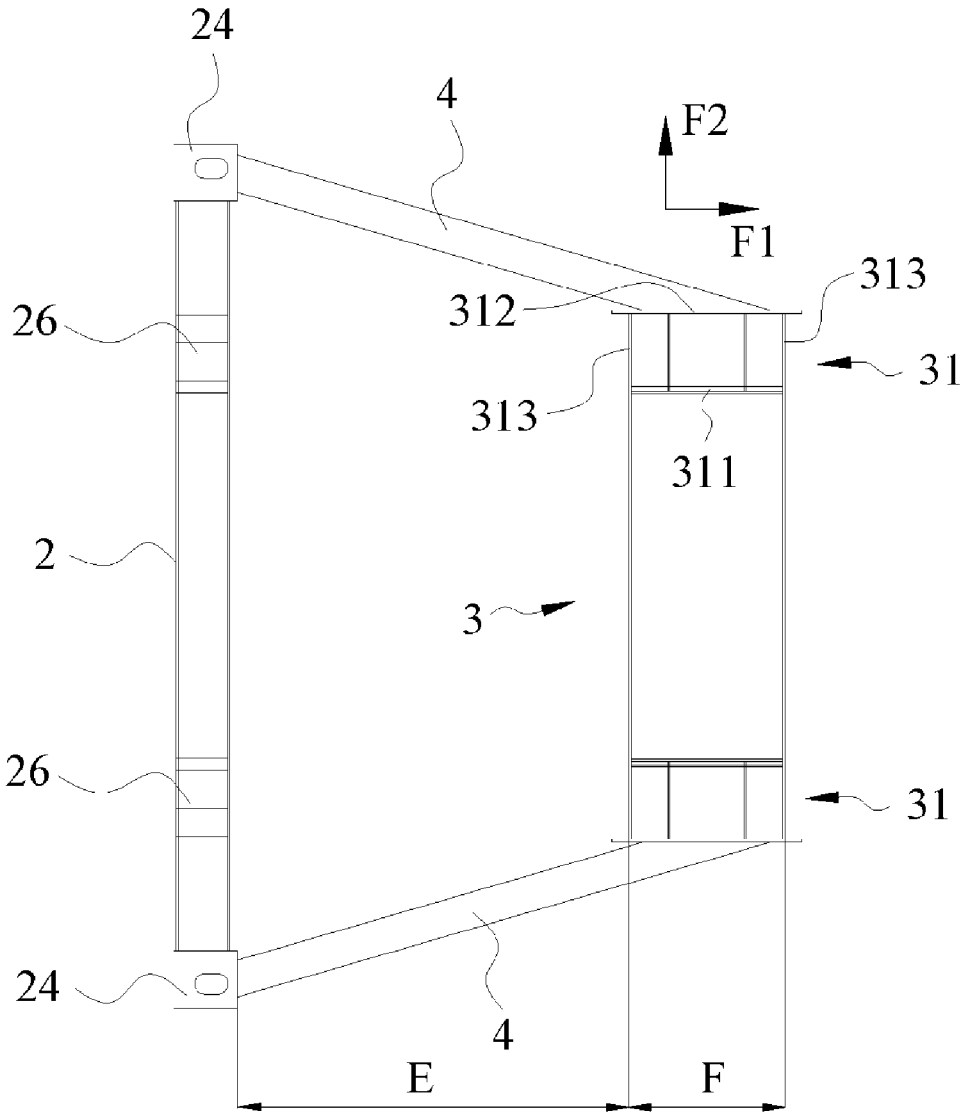
FIG. 2 shows a structural representation in A direction in FIG. 1 (the tank is omitted).
Figure 3:
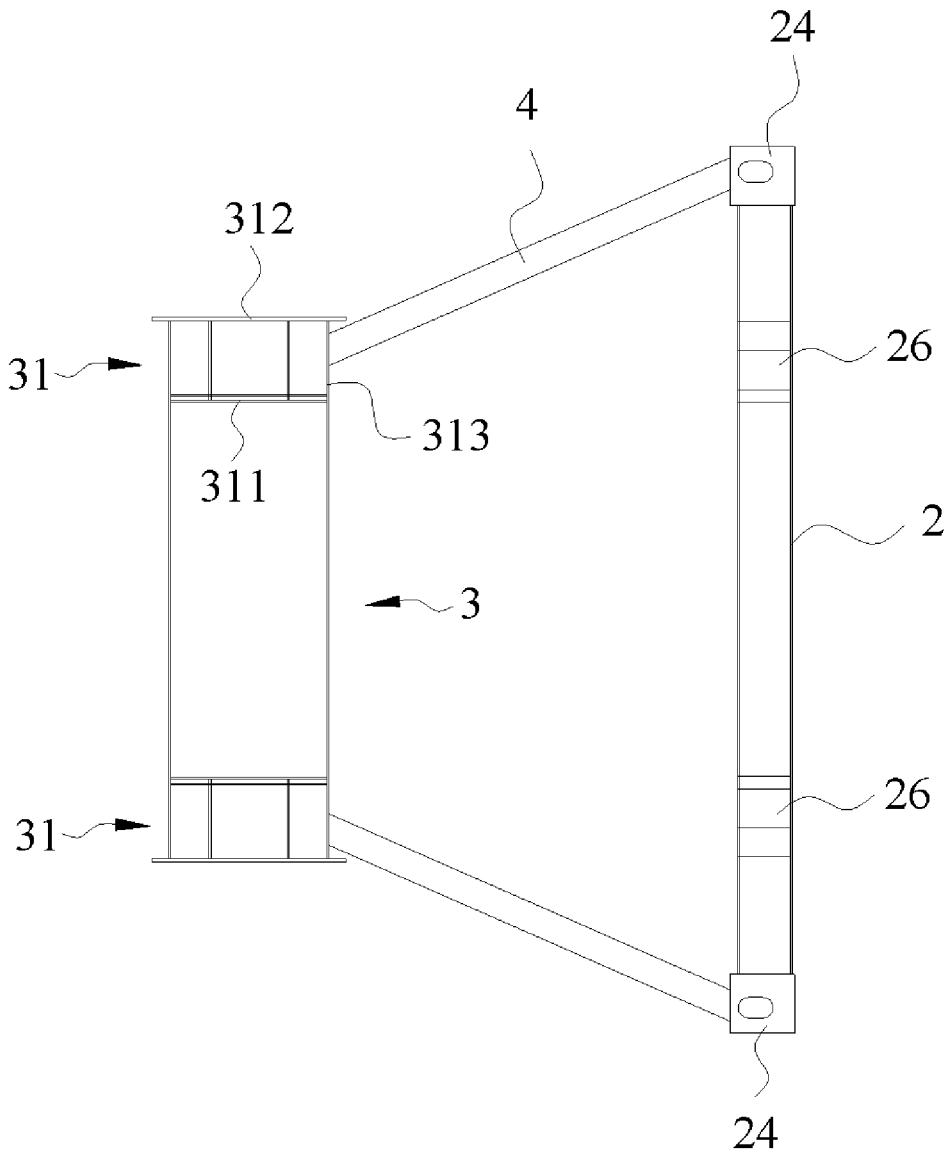
FIG. 3 shows a structural representation in B direction in FIG. 1 (the tank is omitted).

Please refer to FIGS. 1, 2 and 3, one of the two saddles 3 is close to the end frame 2 at one end of the tank 1, and another one of the two saddles is close to the end frame 2 at another end of the tank 1. The number of the saddles 3 may not be limited to two, one or more saddles may be provided, however, in any case, there should be at least one of the saddles 3 which is close to one of the end frames 2 and has a gap E between the end frame 2 and itself, such that the gap E forms an open space between the saddles 3 at the bottom of tank type container and the end frame 2. On the one hand, such an open space may provide a passing channel for the gooseneck of the semitrailer entering into the bottom of the saddles 3. On the other hand, due to the open space, a length of the saddles 3 itself (the longitudinal length of the saddle) may be shortened. In this embodiment, the length F of the saddle 3 itself (the longitudinal length of the saddle) may be about 25 mm-600 mm, compared with the saddle of the related art, the saddle 3 in the embodiment can save more material, have a lower cost, and less weight, and therefore be more advantageous in competition.

Preferably, the two saddles 3 are symmetric about a lateral central plane of the tank 1, so as to ensure the stress of the tank to be distributed uniformly. Moreover, in order to improve the bearing effect of the saddles 3, two inclined struts 4 are connected between each saddle 3 and an adjacent end frame 2. One end of each of the two inclined struts 4 is open outwardly and has a splayed shape. Each of the inclined struts 4 has one end connected to the bottom of the end frame 2 close to outside (i.e., a bottom end of the bottom corner fitting 24 or the corner pillar 21 close to outside), and the other end connected onto the tank supporter 31 of the respective saddle 3. The inclined struts 4 may connect the saddles 3 and the end frame 2 into an integrated entity, and decompose a lateral force F2 along a middle portion of the tank 1 outwardly applied to the saddles 3 and a longitudinal force F1 from end portions toward the middle portion of the tank 1, so as to improve a strength of the saddles 3, and prolong a service life of the saddles 3.

A gap between a front end face of the saddle 3 and a rear end face of the end frame 2 (a rear end face of the bottom corner fitting 24 of the end frame 2) may has a distance in a range of 420 mm-1820 mm. It is known from stress analysis, the saddle 3 connected to the inclined struts 4 in such position may set the opening angle of the inclined struts 4 in a suitable range, and achieve a better decomposition effect on the lateral force F2 and the longitudinal force F1 applied to the saddle 3, thus achieving a better bearing effect. More preferably, when the saddle 3 is disposed at a position with a distance of 1322 mm from the rear end face of the end frame (a distance of 1500 mm from the front end face of the end frame 2), the saddle 3 is just located at a center position of the gooseneck of the semitrailer, such that the front end of the tank is more secure for bearing load. Moreover, for some of the semitrailers having a lateral bearing beam, the saddle 3 is disposed at a position with a distance of 1322 mm from the rear end face of the end frame, just located on the lateral bearing beam; hence the safety of the front end of the tank is further improved.

The saddle 3 may be implemented in various specific structures. Several preferred embodiments of the saddle 3 would be discussed by referring FIGS. 4 to 11.

First Embodiment for Saddle

Figure 4:
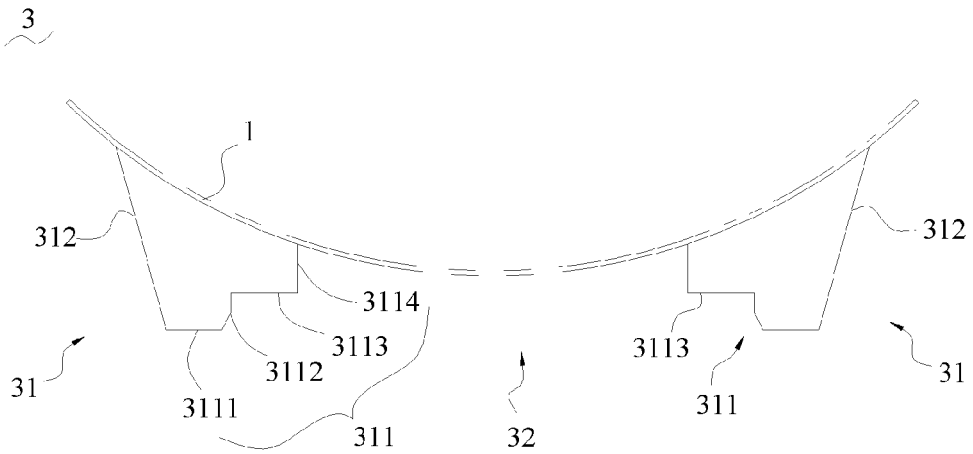
FIG. 4 shows a structural representation of a saddle in a first embodiment.

Please refer to FIG. 4, in this embodiment; the saddle 3 comprises two tank supporters 31 oppositely disposed in the lateral direction. The two tank supporters 31 are symmetric about a longitudinal central plane of the tank. The two tank supporters 31 on the same saddle 3 are separated from each other, and form a gooseneck groove 32 between the two tank supporters 31. When the tank type container is matched with a semitrailer having a gooseneck structure, a front end of the gooseneck structure of the semitrailer may enter into the gooseneck groove 27 of the end frame 2 (FIG. 13), and a rear end of the gooseneck structure may enter into the gooseneck groove 32 between the two tank supporters 31. In order to prevent the front and rear ends of the gooseneck structure of the semitrailer becoming unstable, a distance between the two tank supporters 31 may be equal to a distance between the two end frame supporters 26, and both equal to a width of the gooseneck structure of the semitrailer.

The tank supporter 31 has a hollow structure, which is formed by assembling a plurality of plates or integrally-formed. The tank supporter 31 comprises an inner support plate 311 and an outer support plate 312. The outer support plate 312 is disposed on an outer side of the tank 1, and the inner support plate 311 is disposed on an inner side of the outer support plate 312.

The inner support plate 311 has a step-like shape. More specifically, the inner support plate 311 from bottom to top comprises: a bottom subsection 3111, a side subsection 3112, a shoulder subsection 3113, and a neck subsection 3114. The bottom subsection 3111 is parallel to a horizontal plane. The side subsection 3112 is formed by initially extending inclined upward and inward from an inner end of the bottom subsection 3111 and then vertically extending upward. The shoulder subsection 3113 is formed by horizontally extending inward from an upper end of the side subsection 3112. The neck subsection 3114 is formed by vertically extending upward from an inner end of the shoulder subsection 3113. For example, in the positions and directions shown in FIG. 4, the side subsection 3112 of the left inner support plate 311 is formed by initially extending inclined toward an upper right direction from a right end of the bottom subsection 3111 and then vertically extending upward, and the shoulder subsection 3113 of the left inner support plate 311 is formed by horizontally extending rightward from an upper end of the side subsection 3112 of the left inner support plate 311, in addition, the neck subsection 3114 of the left inner support plate 311 is formed by vertically extending upward from a right end of the shoulder subsection 3113 of the left inner support plate 311.

The outer support plate 312 is an inclined plate which inclines gradually from bottom to top outward.

A bottom end of the inner support plate 311 and a bottom end of the outer support plate 312 of the same tank supporter 31 (an outer end of the bottom subsection 3111) are connected to each other. A top end of the inner support plate 311 (a top end of the neck subsection 3114) and a top end of the outer support plate 312 of the same tank supporter 31 are separated from each other. Moreover, a top end of the inner support plate 311 (a top end of the neck subsection 3114) and a top end of the outer support plate 312 both are connected onto an outer wall of the tank 1.

The inner support plates 311 of the two tank supporters 31 of the same saddle 3 are separated from each other. The inner support plate 311, the outer support plate 312 of every of the tank supporters 31 and the outer wall of the tank 1 form a hollow cavity with both front and rear ends opened, such that each of the tank supporters 31 has a structure of a hollow box, so as to ensure support strength and reduce weight of the tank supporters 31 as much as possible at the same time, thus reducing weight of the tank type container itself, and reducing transportation cost.

The shoulder subsection 3113 of the inner support plate 311 of the tank supporter 31 is horizontal, and is flush with the shoulder subsections 3113 of the two tank supporters 31 of the same saddle 3. When the saddle 3 cooperates with the gooseneck structure of the semitrailer, the bottom surfaces of the shoulder subsections 3113 would function as a load transfer surface, and directly contact the gooseneck structure of the semitrailer to transfer load carried by the tank supporters 31 onto the semitrailer. Further, the bottom subsection 3111 of the inner support plate 311 of the tank supporters 31 is also horizontal; moreover, the bottom subsections 3111 of the two tank supporters 31 of the same saddle 3 are also flush with each other, and the bottom surfaces of the bottom subsections 3111 form another load transfer surface. When the saddle 3 cooperates with a semitrailer having no gooseneck structure, the bottom subsections 3111 of the inner support plates 311 may directly contact the bearing surface of the semitrailer to transfer load carried by the tank supporters 31 onto the semitrailer.

Considering load-bearing performance of the tank 1 required for the saddle 3, in an embodiment, a circumferential wrapping angle of the saddle 3 (i.e., an angle of the tank 1 surrounded between the outer support plates 312 of the two tank supporters 31) for the tank 1 is preferably in a range of about 90° to 150°.

Second Embodiment for Saddle

Figure 5:
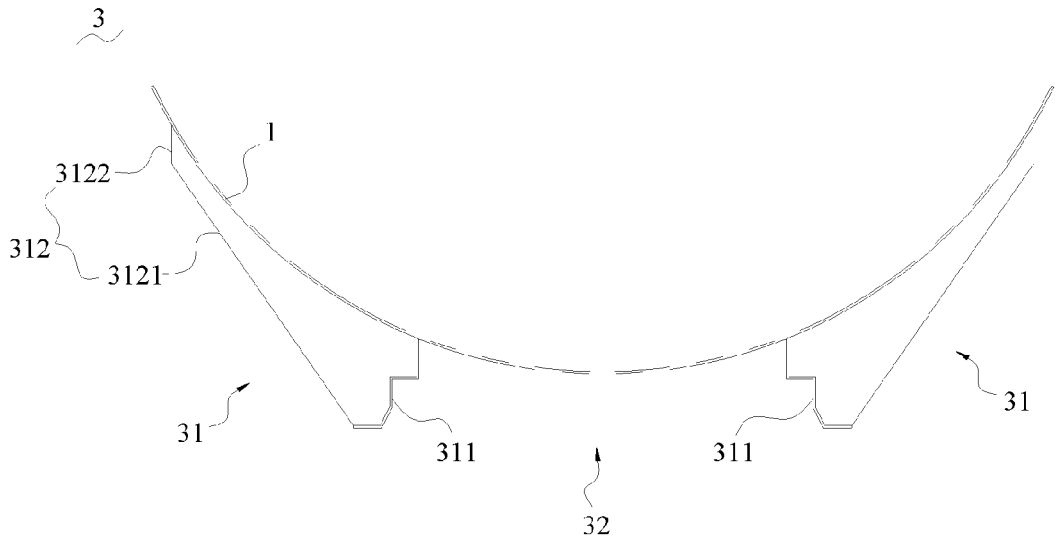
FIG. 5 shows a structural representation of a saddle in a second Embodiment.

Please refer to FIG. 5; the difference of the saddle 3 in this embodiment compared with the saddle 3 in the first embodiment is the structure of the outer support plate 312. In this embodiment, the outer support plate 312 comprises an inclined section 3121 which inclines gradually from bottom to top outward and a vertical section 3122 which is formed by vertically extending upward from a top end of one of the inclined section 3121. A bottom end of each of the inclined sections 3121 and the inner support plate 311 are connected to each other, a top end of each of the vertical sections 3122 and an outer wall of the tank 1 are connected to each other.

In this embodiment, a wrapping angle of the saddle 3 for the tank 1 (i.e., an angle of the tank 1 surrounded between the outer support plates 312 of the two tank supporters 31) is preferably in a range of about 90° to 150°.

Third Embodiment for Saddle

Figure 6:
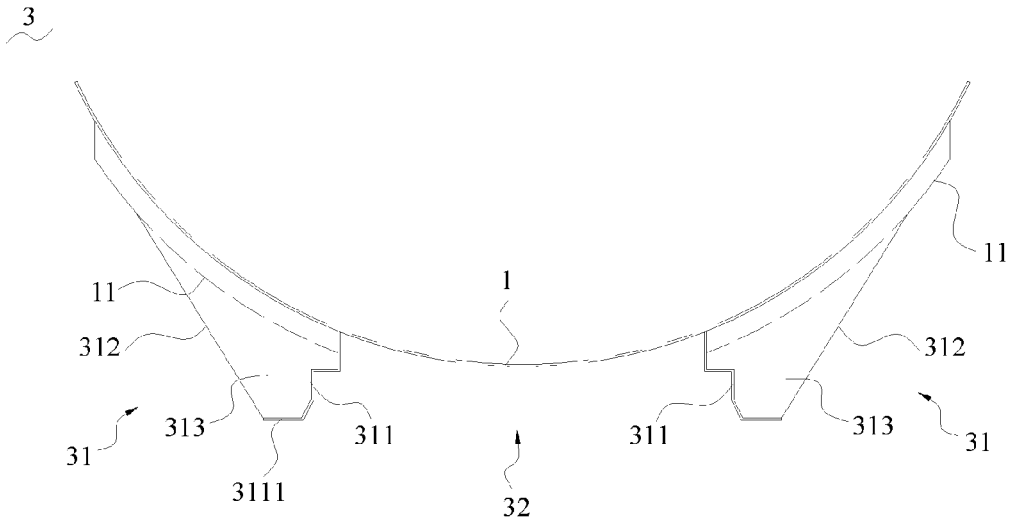
FIG. 6 shows a structural representation of a saddle in a third Embodiment.

Please refer to FIG. 6, the difference of the saddle 3 in this embodiment compared with the saddle 3 in first embodiment is: an outer wall of the tank 1 has an arc stiffener 11 circumferentially disposed thereon, a bottom end of the outer support plate 312 and a bottom end of the inner support plate 311 (an outer end of the bottom subsection 3111 of the inner support plate 311) are connected to each other, a top end of the outer support plate 312 is fixed onto the stiffener 11. The inner support plate 311, the outer support plate 312 of the respective the tank supporters 31 and the stiffener 11 on the outer wall of the tank 1 form a hollow cavity with both ends opened.

Further, each of the tank supporters 31 has two end covers 313 additionally disposed therein. The two end covers 313 are oppositely disposed at both ends of the tank supporters 31 in the longitudinal direction. Each of the end covers 313 has an outer side connected to the outer support plate 312, an inner side connected to the inner support plate 311, and a top connected to the stiffener 11 on the outer wall of the tank 1, so as to close the opened ends of the hollow cavity of the tank supporter 31 for preventing rain and dust from entering inside the tank supporters 31, in addition, the end covers 313 may support the tank 1 as well, so as to share load carried by the inner support plate 311 and the outer support plate 312 for improving a strength of the tank supporters 31. The end covers 313 may be disposed in any other embodiment as required.

In this embodiment, a wrapping angle of the saddle 3 for the tank 1 (i.e., an angle of the tank 1 surrounded between the outer support plates 312 of the two tank supporters 31) is preferably in a range of about 90°-150°.

Fourth Embodiment for Saddle

Figure 7:
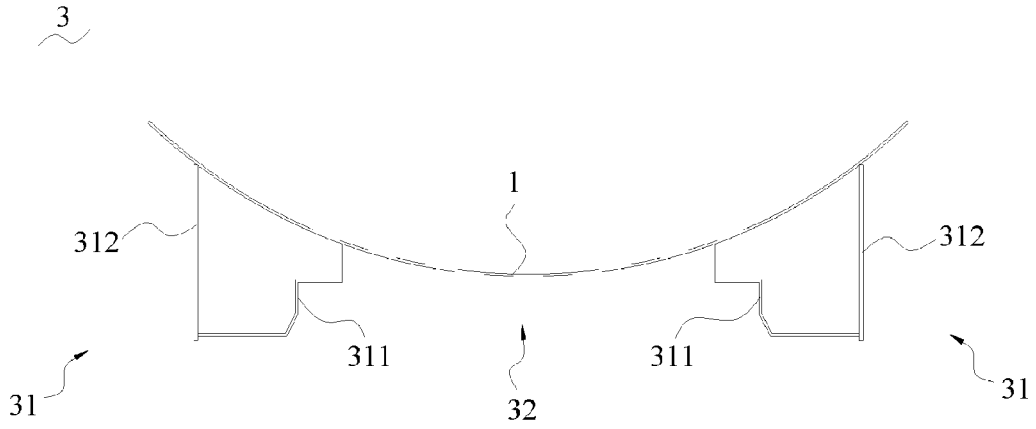
FIG. 7 shows a structural representation of a saddle in a fourth embodiment.

Please refer to FIG. 7; the difference of the saddle 3 in this embodiment compared with the saddle 3 in the first embodiment is the structure of the outer support plate 312. In this embodiment, the outer support plate 312 is a vertical plate, which is perpendicular to a horizontal plane. The saddle 3 having such structure may occupy less space on both sides of the tank 1, and provide an avoidance space for an operating box installed on a side of the tank 1.

In this embodiment, a wrapping angle of the saddle 3 for the tank 1 (i.e., an angle of the tank 1 surrounded between the outer support plates 312 of the two tank supporters 31) is preferably in a range of about 90° to 150°.

The common points of the saddle in the first, second, third, and fourth embodiments are as follows: the two tank supporters 31 of the saddle 3 are separated from each other, the gooseneck groove 32 is formed by the inner support plates 311 of the two tank supporters 31 and the outer wall of the tank 1, and the gooseneck groove 32 has an unblocked top, such that the tank 1 may be arranged as low as possible, in order to lower a barycenter of the tank 1 and improve safety of the tank type container.

Fifth Embodiment for Saddle

Figure 8:
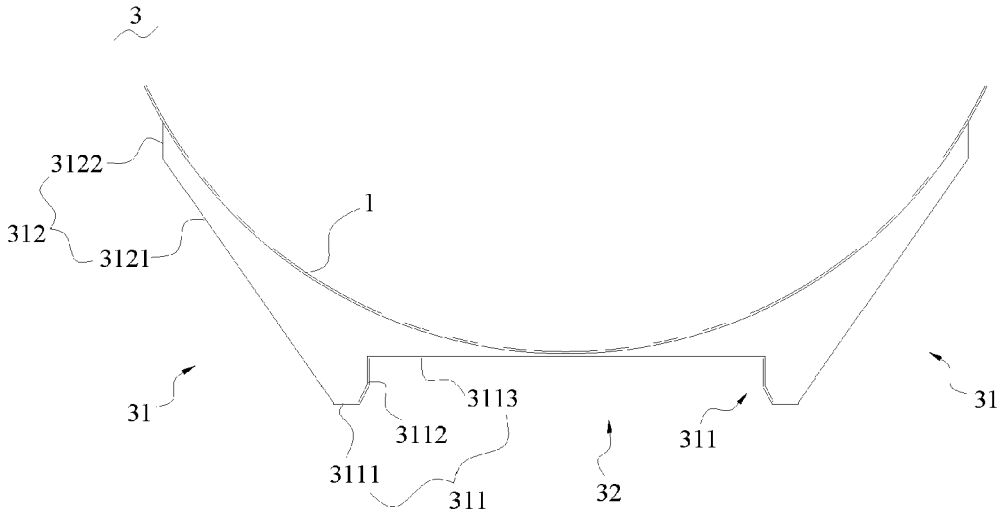
FIG. 8 shows a structural representation of a saddle in a fifth embodiment.

Please refer to FIG. 8, the major difference of the saddle 3 in this embodiment is, compared with the saddle 3 in the first, second, third, and fourth embodiments, the two tank supporters 31 on the same saddle 3 are connected into an integrated entity.

More specifically, the inner support plates 311 of the two tank supporters 31 of the same saddle 3 are connected into an integrated entity. The inner support plate 311 has a step-like shape, and comprises a bottom subsection 3111, a side subsection 3112, and a shoulder subsection 3113. The bottom subsection 3111 is parallel to a horizontal plane. The side subsection 3112 is formed by initially inclining upward and inward from the bottom subsection 3111 and then vertically extending upward. The shoulder subsection 3113 is formed by horizontally extending inward from a top end of the side subsection 3112. Moreover, the shoulder subsections 3113 of the two tank supporters 31 are flush with each other and are connected into an integrated entity. In manufacturing, the inner support plates 311 of the two tank supporters 31 may be formed by a piece of flat plate integrally bent.

It is preferable to arrange a short distance between the shoulder subsection 3113 of the inner support plate 311 and the outer wall of the tank 1, so as to prevent the tank 1 protruded downward under full load from interfering with the shoulder subsection 3113 of the inner support plate 311, thus improving safety of the tank 1.

The structure of the outer support plate 312 in this embodiment is substantively as same as the structure of the outer support plate 312 of the saddle 3 in the second Embodiment, and comprises an inclined section 3121 which inclines gradually from bottom to top outward and a vertical section 3122 which is formed by vertically extending upward from a top end of one of the inclined section 3121. A bottom end of the inclined section 3121 and the inner support plate 311 are connected to each other. Moreover, a top end of each of the vertical sections 3122 and an outer wall of the tank 1 are connected to each other.

The two outer support plates 312 and the two inner support plates 311 of the two tank supporters 31 as well as an outer wall of the tank 1 form a hollow cavity with both front and rear ends opened.

Sixth Embodiment for Saddle

Figure 9:
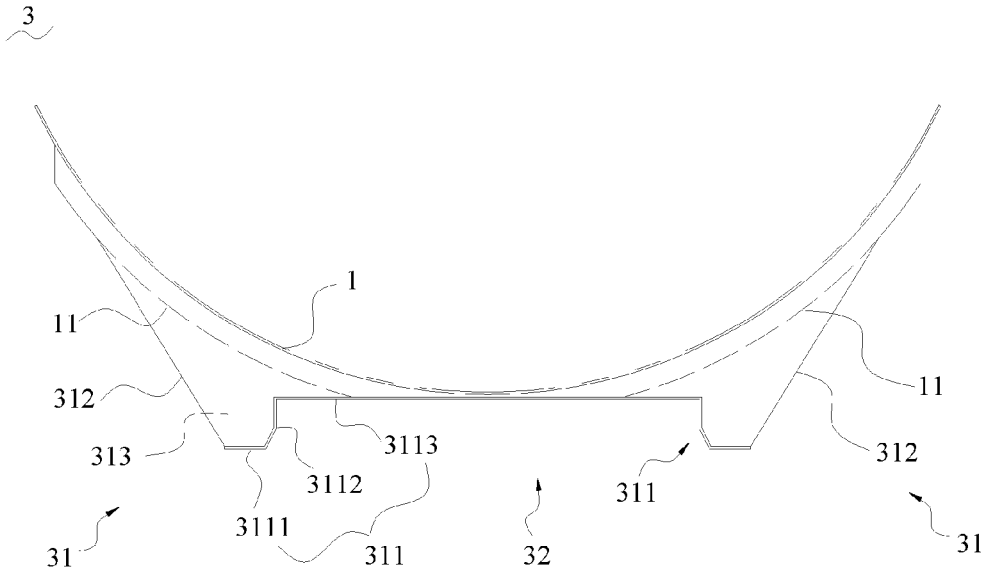
FIG. 9 shows a structural representation of a saddle in a sixth embodiment.

Please refer to FIG. 9, the difference of the structure of the saddle 3 in this embodiment compared with the structure of the saddle 3 in the fifth embodiment is: an outer wall of the tank 1 has a stiffener 11 circumferentially disposed thereon, a bottom end of the outer support plate 312 and a bottom end of the inner support plates 311 (an outer end of the bottom subsection 3111 of the inner support plates 311) are connected to each other, and a top end of the outer support plate 312 is fixed onto the stiffener 11.

The saddle 3 forms a hollow cavity with both of a front end and a rear end opened. More specifically, the hollow cavity is formed by the two outer support plates 312 and the two inner support plates 311 of the two tank supporters 31 and the stiffener 11 on the outer wall of the tank 1. Further, two end covers 313 are disposed at the opened ends of the hollow cavity. More specifically, the two end covers 313 are oppositely disposed at both ends of the tank supporters 31, and two outer sides of the end covers 313 and the outer support plates 312 of the two tank supporters 31 are respectively connected to each other. Each of the end covers 313 has a top connected to the stiffener 11 on the outer wall of the tank 1, and a bottom connected to the inner support plates 311 of the two tank supporters 31, thus closing the opened ends of the hollow cavity of the saddle 3.

The structure of the outer support plate 312 in this embodiment is substantively a same as the structure of the outer support plate 312 of the saddle 3 in the first embodiment, and is an inclined plate which inclines gradually from bottom to top outward, and has a top end connected onto the stiffener 11 and a bottom end connected to the inner support plates 311.

Seven Embodiments for Saddle

Figure 10:
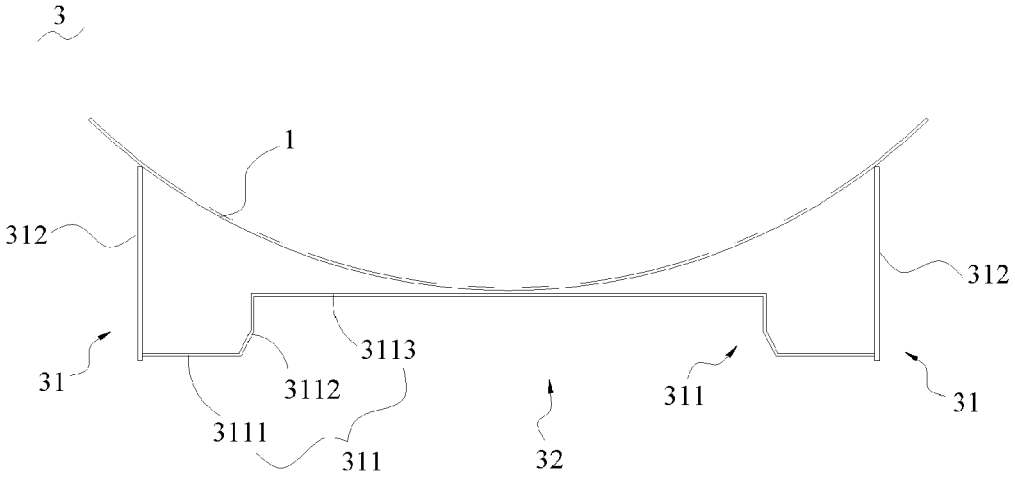
FIG. 10 shows a structural representation of a saddle in a seven embodiment.

Please refer to FIG. 10; the difference of the structure of the saddle 3 in this embodiment compared with the structure of the saddle 3 in the fifth embodiment is the structure of the outer support plate 312. More specifically, in this embodiment, the outer support plate 312 is a vertical plate perpendicular to a horizontal plane. The saddle 3 of such structure may occupy less space on both sides of the tank 1, and provide an avoidance space for an operating box installed on a side of the tank 1.

Eight Embodiments for Saddle

Figure 11:
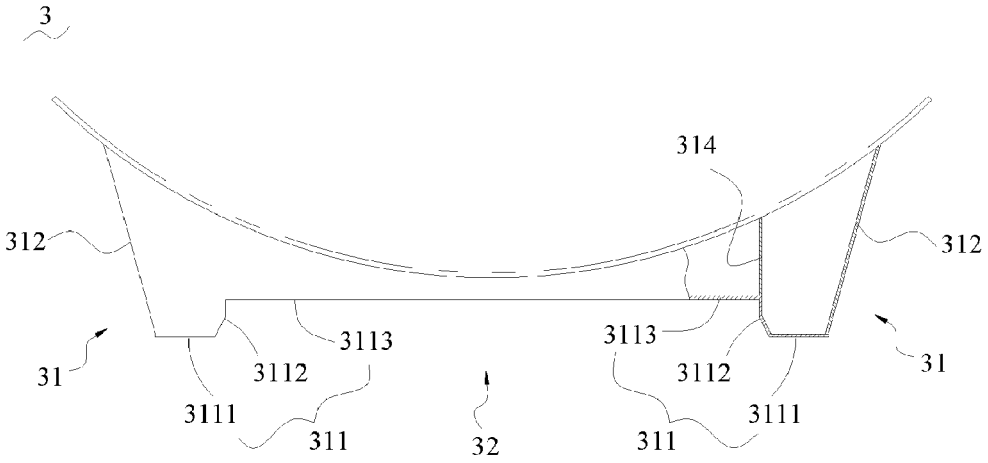
FIG. 11 shows a structural representation of a saddle in an eight embodiment.

Please refer to FIG. 11, the difference of the structure of the saddle 3 in this embodiment compared with the structure of the saddle 3 in the fifth embodiment is: the gap between the outer wall of the tank 1 and the shoulder subsection 3113 of the inner support plate 311 has a greater distance, and two reinforcing plates 314 between the outer wall of the tank 1 and the shoulder subsection 3113 of the inner support plate 311. The two reinforcing plates 314 are distributed in the longitudinal direction, and respectively located right above the side subsections 3112 of the two inner support plate 311 (only one reinforcing plate 314 is shown). Each of the reinforcing plates 314 and an adjacent outer support plate 312, the bottom subsection 3111 and the side subsection 3112 of the inner support plates 311, and the outer wall of the tank 1 form a hollow cavity. Another hollow cavity is formed between the two reinforcing plates 314, and this hollow cavity is formed by the two reinforcing plates 314, the shoulder subsection 3113 of the two inner support plates 311, and the outer wall of the tank 1.

The common points of the saddle 3 in the fifth, sixth, seventh, and eighth embodiments are: the inner support plates 311 of the two tank supporters 31 of the saddle 3 are connected into an integrated entity, the gooseneck groove 32 is formed by the inner support plates 311 of the two tank supporters 31, the shoulder subsections 3113 of the inner support plates 311 cover a top of the gooseneck groove 32, so as to prevent the gooseneck structure of the semitrailer from directly contacting the outer wall of the tank 1, thus providing a protection for the outer wall of the tank 1, and simultaneously improving a strength of the gooseneck groove 32.

Please refer to FIGS. 2 and 3, each of the inclined struts 4, if connected to the respective tank supporter 31, may be connected either onto the outer support plate 312 of the tank supporters 31, or connected onto the end cover 313 of the tank supporter 31. When the inclined strut 4 is connected to the outer support plate 312 of the tank supporters 31, the outer support plate 312 is preferably a vertical plate perpendicular to a horizontal plane (i.e., the structure of the outer support plate 312 as shown in FIGS. 7 and 10).

Figure 16:
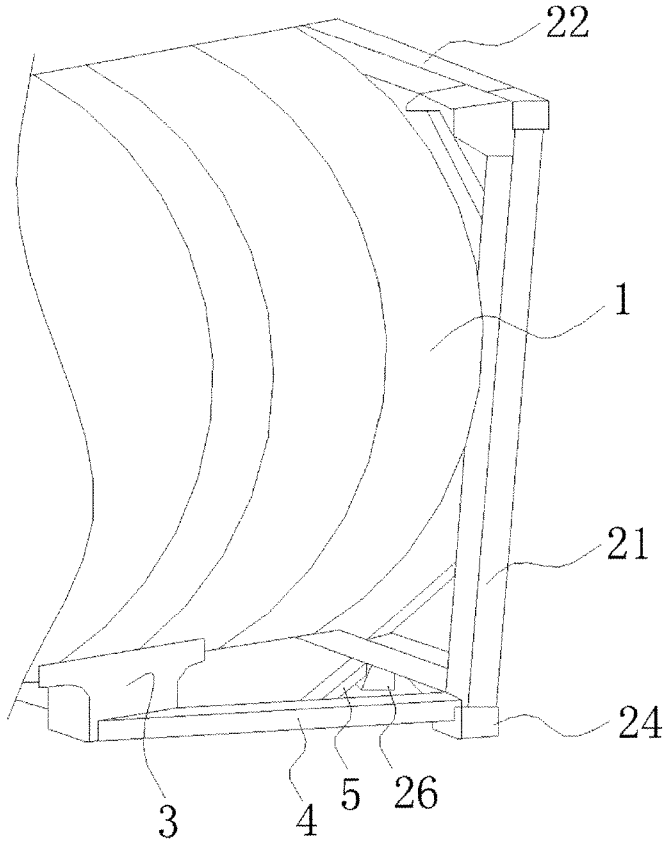
FIG. 16 shows a structural representation a corner of a tank type container.

Please refer to FIG. 16; a corner supporter 5 is further connected between the inclined strut 4 and the end frame supporter 26. On the one hand, the corner supporter 5 may improve stability of the end frame 2; on the other hand, it may connect the saddle 3 and the end frame supporters 26 supporting the tank 1 into an integrated entity, so as to provide a stable bottom supporting structure, thus proving overall strength of the tank type container. Since the corner supporter 5 has a best balance in a horizontal state, a height of the inclined strut 4 should be equal to a height of the end frame supporters 26 as possible, so as to ensure the corner supporter 5 is kept horizontal.

Figure 17:
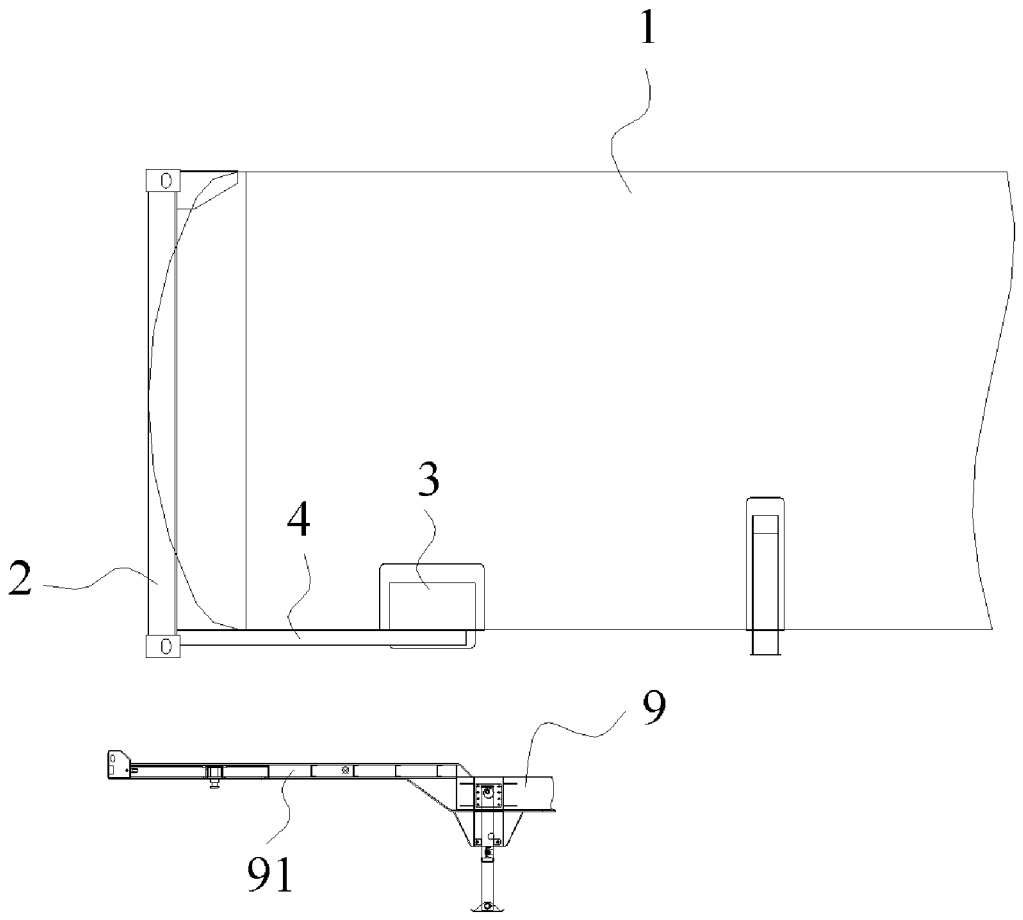
FIG. 17 shows an assembly drawing of a tank type container and a semitrailer.

Please refer to FIG. 17, when the tank type container according to the disclosure is matched with the semitrailer 9 having a gooseneck structure, the front end of the gooseneck structure 91 of the semitrailer 9 may enter the gooseneck groove 27 at the bottom of the end frame 2 (as shown in FIG. 13), and the rear end of the gooseneck structure may enter the gooseneck groove 32 at the bottom of the tank 1 (as shown in FIGS. 4 to 11). Here, the bottom surface of the end lower beam 23 of the end frame 2 and a top surface of the gooseneck structure 91 of the semitrailer 9 are in contact with each other, and the bottom surface of the shoulder subsection 3113 of the inner support plates 311 of the tank supporters 31 and a top surface of the gooseneck structure 91 of the semitrailer 9 are in contact with each other, such that the bottom surface of the end lower beam 23 of the end frame 2 and the bottom surface of the shoulder subsection 3113 of the inner support plates 311 form a first set of load transfer area for transferring weight of the tank 1 onto the semitrailer.

The tank type container according to the disclosure may be matched with a semitrailer having no gooseneck structure, and in matching, the tank type container may be directly located onto a top surface of the semitrailer, and fixed to the semitrailer via corner fittings. Here, both the bottom surface of the end frame supporter 26 (the bottom surface of the bottom plate 263 in FIG. 13) and the bottom surface of the tank supporters 31 (the bottom subsections 3111 of the inner support plates 311 in FIGS. 4 to 11) directly contact the top surface of the semitrailer, and form a second set of load transfer area for transferring the tank 1 weight of onto the semitrailer.

Depending on specific applications, the first set of load transfer area and the second set of load transfer area may be provided separately, or be respectively provided alone.

The disclosure is described in detail by referring several typical embodiments, though, it is to be understood, and all the terms used above are merely illustrative and exemplary, rather than limitative. Since the disclosure may be carried out in many specific manners without departing the principles or essential of the present disclosure, it is to be clearly understood that, the present disclosure is not limited to any detail of the foregoing description, rather, the disclosure may be widely interpreted in a range limited solely by the appended claims and their equivalents. It is, therefore, intended that the appended claims encompass any variations and modifications or embodiments.

What is claimed is:

1. A tank container comprising:

a tank;

two end frames respectively fixed to both ends of the tank; and at least one saddle located at a bottom of an outer wall of the tank, a gooseneck groove concave upwards is formed in the bottom of the saddle for allowing insertion of a gooseneck at a front end of a semitrailer, and the at least one saddle is close to one of the end frames and has a gap formed between itself and the end frame wherein the gap has a distance of 420 mm-1820 mm between a front end face of the saddle and a rear end face of the end frame and the saddle has a length of 25 mm-600 mm.

2. The tank container according to claim 1, wherein the saddle comprises two tank supporters oppositely disposed in the lateral direction, and the gooseneck groove is formed between the two tank supporters.

3. The tank container according to claim 2, wherein the two tank supporters of the same saddle are separated from each other.

4. The tank container according to claim 2, wherein the two tank supporters of the same saddle are connected into an integrated entity.

5. The tank container according to claim 2, wherein the tank supporters have a hollow structure formed by assembling a plurality of plates or integrally-formed.

6. The tank container according to claim 5, wherein each of the tank supporters comprises an inner support plate and an outer support plate, the outer support plate is disposed an outer side of the tank, the inner support plates is disposed on an inner side of the outer support plate, and the inner support plate, the outer support plate, and an outer wall of the tank form a hollow cavity.

7. The tank container according to claim 6, wherein the inner support plates of the two tank supporters of the same saddle are separated from each other, a bottom end of the inner support plates and a bottom end of the outer support plates of the same tank supporter are connected to each other, a top end of the inner support plates and a top end of the outer support plate of the same tank supporter are separated from each other, and top ends of the inner support plates and the outer support plates are all connected onto the outer wall of the tank and each of the supporters and the outer wall of the tank form a hollow cavity with both front and rear ends opened.

8. The tank container according to claim 7, wherein the inner support plate from bottom to top comprises: a bottom subsection, a side subsection, a shoulder subsection, and a neck subsection, the bottom subsection is parallel to a horizontal plane, the side subsection is formed by initially extending inclined upward from an inner end of the bottom subsection and then vertically extends upward, the shoulder subsection is formed by horizontally extending inward from an upper end of the side subsection, the neck subsection is formed by vertically extending upward from an inner end of the shoulder subsection, a top end of the neck subsection and the outer wall of the tank are connected to each other; the shoulder subsections of the two tank supporters of the same saddle are flush with each other, and bottom surfaces of the shoulder subsections form a horizontal load transfer surface and;

the bottom subsections of the two tank supporters of the same saddle are flush with each other and bottom surfaces of the bottom subsections form another load transfer surface.

9. The tank container according to claim 7, wherein each of the tank supporters is provided with two end covers, the two end covers are oppositely disposed at both ends of the tank supporters, and the end covers are respectively connected to the inner support plates, the outer support plate, and the outer wall of the tank, so as to close the opened front and rear ends of the hollow cavity.

10. The type container according to claim 6, wherein the inner support plates of the two tank supporters of the same saddle are connected into an integrated entity, the two tank supporters and the outer wall of the tank form a hollow cavity with both front and rear ends opened, the inner support plate comprises a bottom subsection, a side subsection, and a shoulder subsection, the bottom subsection is parallel to a horizontal plane, the side subsection is formed by initially extending inclined upward from the bottom subsection and then vertically extends upward, the shoulder subsection is formed by horizontally extending inward from a top end of the side subsection, and the shoulder subsections of the two tank supporters are flush with each other and connected into an integrated entity.

11. The tank container according to claim 10, wherein there is a gap between the outer wall of the tank and the shoulder subsection of the inner support plate, and a reinforcing plate is connected between the outer wall of the tank and the shoulder subsection of the inner support plate, and the reinforcing plate is distributed in the longitudinal direction, and located right above the side subsection of the inner support plate.

12. The tank container according to claim 10, wherein each saddle is provided with two end covers, the two end covers are oppositely disposed at both ends of the saddle, and the end covers are respectively connected to the outer support plate, the inner support plate, and the outer wall of the tank, so as to close the opened front and rear ends of the hollow cavity.

13. The tank container according to claim 6, wherein the outer support plate is perpendicular to a horizontal plane.

14. The tank container according to claim 6, wherein the outer support plate comprises an inclined section inclining gradually from bottom to top outward and a vertical section vertically extending upward from a top end of the inclined section.

15. The tank container according to claim 6, wherein a bottom end of the outer support plate and a bottom end of the inner support plate are connected to each other, and a top end of the outer support plate is connected onto the outer wall of the tank.

16. The tank container according to claim 15, wherein the outer wall of the tank has an arc stiffener circumferential disposed thereon, a bottom end of the outer support plate and a bottom end of the inner support plate are connected to each other, and a top end of the outer support plate is fixed onto the stiffener.

17. The tank container according to claim 15, wherein two inclined struts are connected between each saddle and the adjacent end frame, the two inclined struts form a splayed shape, each of the inclined struts has one end connected onto the tank supporter, and has the other end connected to the bottom of the end frame at a position close to outside.

18. The tank container according to claim 1, wherein a wrapping angle of the saddle for the tank is 90°-150°.

19. The tank container according to claim 1, wherein a number of the saddles is two, one of the saddles is close to one end of the tank, another one of the saddles is close to another end of the tank, and the two saddles are symmetric about a lateral central plane of the tank.

20. The tank container according to claim 1, wherein an inclined strut is connected between each saddle and an adjacent end frame.

* * * * *